United States Patent [19]

Lautenschläger, Jr.

[11] Patent Number: 4,653,144

[45] Date of Patent: Mar. 31, 1987

[54] ADJUSTABLE ARCUATED CABINET HINGE

[75] Inventor: Karl Lautenschläger, Jr., Reinheim, Fed. Rep. of Germany

[73] Assignee: Karl Lautenschlager KG, Reinheim, Fed. Rep. of Germany

[21] Appl. No.: 844,573

[22] Filed: Mar. 27, 1986

[30] Foreign Application Priority Data

Mar. 29, 1985 [DE] Fed. Rep. of Germany ..... 3511493

[51] Int. Cl.[4] ..... E05D 7/04

[52] U.S. Cl. ..... 16/239; 16/240; 16/249; 16/DIG. 43

[58] Field of Search ..... 16/370, 239, 240, 245, 16/246, 249, 382, DIG. 43, 352, 366, 375

[56] References Cited

U.S. PATENT DOCUMENTS

| | | | |
|---|---|---|---|
| 3,626,548 | 12/1971 | Grunert | 16/370 |
| 3,646,635 | 3/1972 | Stermac | 16/239 |
| 4,142,272 | 3/1979 | Oogami et al. | 16/245 |
| 4,449,269 | 5/1984 | Sundermeier | 16/352 |
| 4,499,631 | 2/1985 | Lautenschläger | 16/370 |

*Primary Examiner*—M. Jordan

[57] ABSTRACT

A hinge for the hanging of a door, especially an inset or recessed glass door, on the carcase of a piece of furniture has a door-related hinge part which is coupled by a linkage mechanism to a wall-related hinge part which can be fastened to a wall of the carcase. The wall-related part in turn is composed of a mounting component that can be fastened to the wall, and of a link holder which is adjustable in a plane at right angles to the hinge pivot axis with respect to the mounting component and can be locked on the latter at selectable positions. The mounting component has a bracket arm projecting from a mounting plate that can be fastened to the wall and has an essentially arcuate mounting surface convexly curved with respect to the wall, on which a complementarily arcuate mounting surface of the link holder can be fastened at selectable relative positions within a particular adjustment range.

10 Claims, 8 Drawing Figures

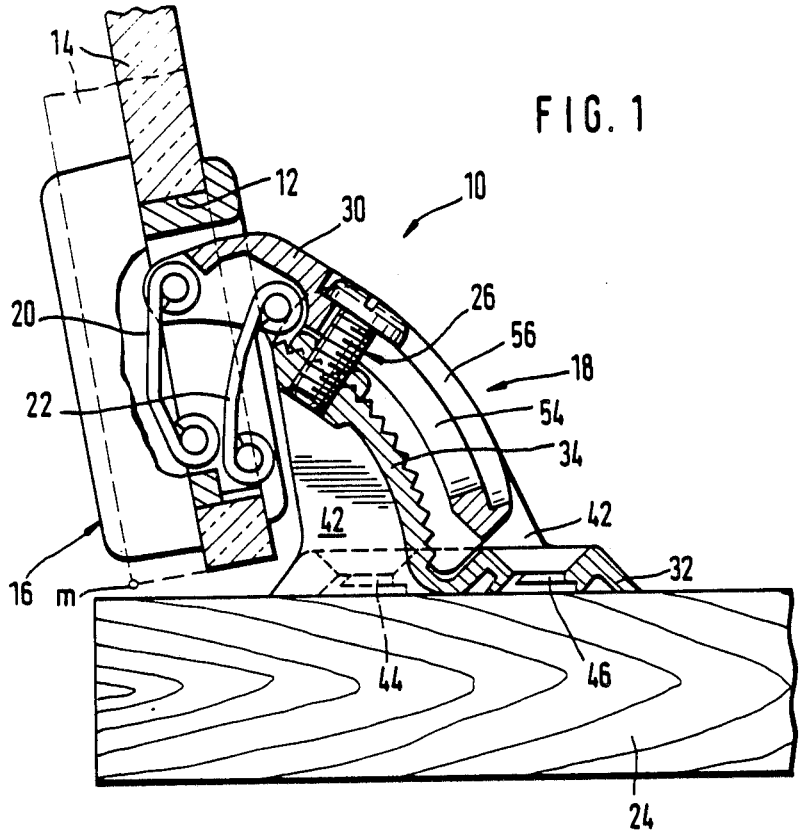
FIG. 1
FIG. 2
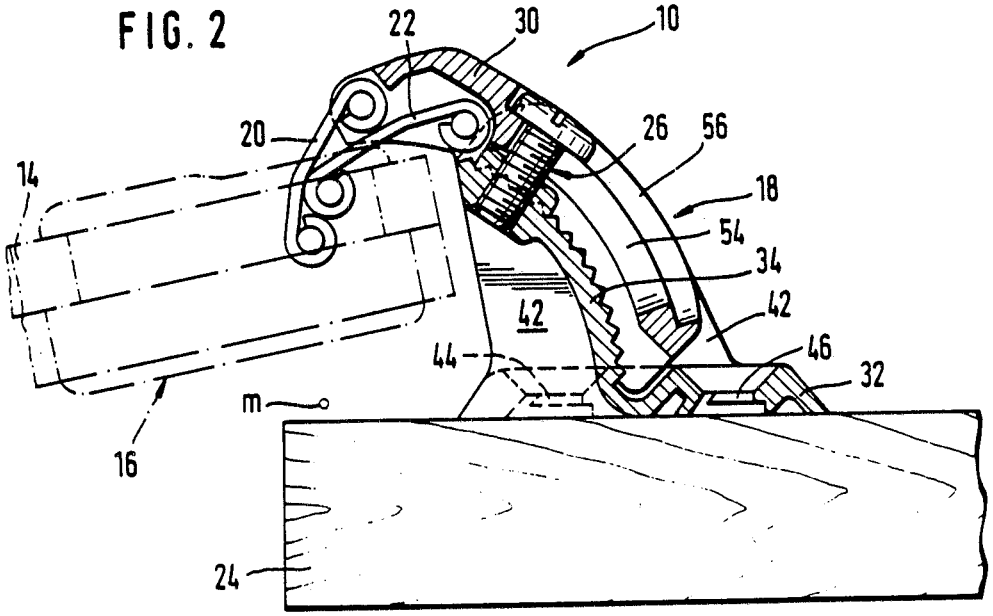

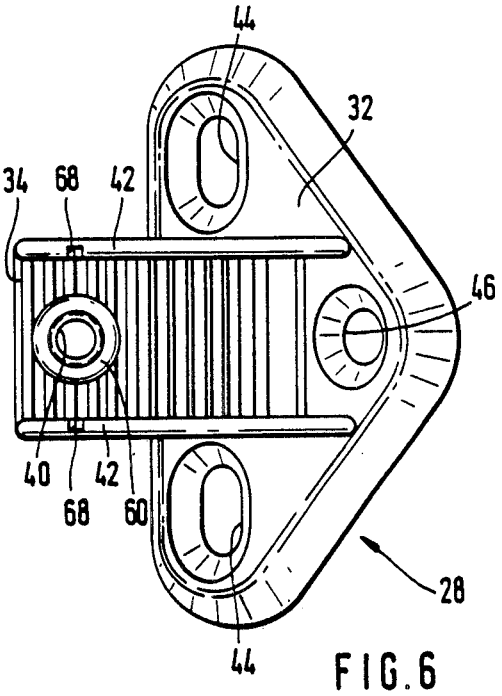
FIG. 6
FIG. 5
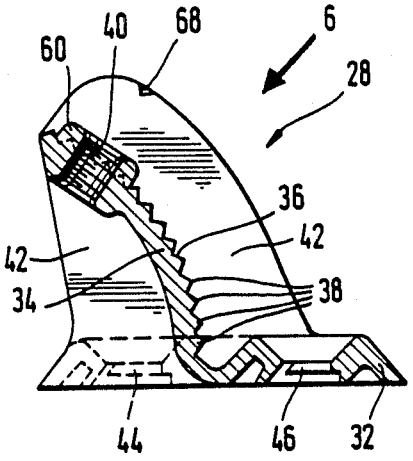
FIG. 8
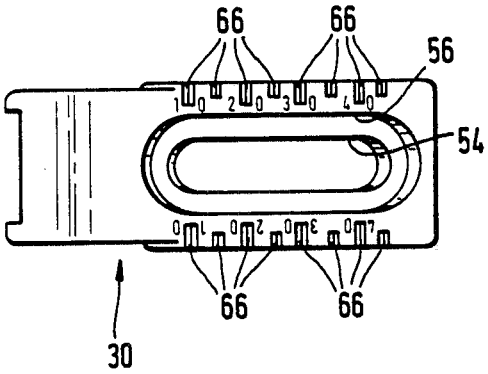
FIG. 7
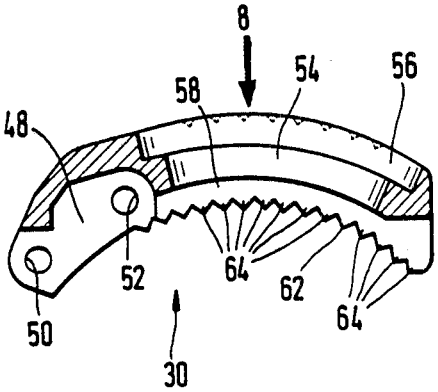

ADJUSTABLE ARCUATED CABINET HINGE

BACKGROUND OF THE INVENTION

The invention relates to a hinge for mounting a door, especially an inset or recessed glass door, on the carcase of a cabinet, the hinge's door-related part being coupled by means of a linkage to its wall-related part which can be affixed to a wall of the cabinet and which is composed of a mounting component that can be fastened to the wall, and a link holder which can be adjusted in a plane disposed at right angles to the hinge pivot axis and can be affixed to the link holder at select positions.

Such hinges, especially in the form of so-called four-pivot hinges, have gained acceptance in modern furniture design for the hanging of doors on a cabinet carcase. The door-related hinge part is usually in the form of a cup which can be inserted or driven flush into a recess or bore in the back of the door, while the wall-related hinge part, coupled to the cup by the linkage, is in the form of a supporting arm mounted for adjustment in two or, in special cases, even three coordinate directions, on a mounting plate fastened fixedly on the inside face of the carcase wall. Normally, the wall forms with the closed door an angle of 90°, and, if the hinge mechanism is a four-pivot mechanism, it can be opened by 90° to 115°. In recent times, however, there have been cabinets in which the wall forms with the closed door an angle other than 90°. In the case of corner cabinets of built-in furniture systems and kitchen cabinets, this angle amounts, for example, to 135°. Moreover, in the case of special furniture, such as cabinets custom-made for particular geometrical conditions, other angles between closed door and wall are called for. Since mass-produced four-pivot hinges cannot be used in such cases, and hinges adapted especially to a particular angle between door and wall are too expensive to manufacture, the hinge of the kind described above was developed (DE-OS 32 17 104) which permits an adaptation to such different angles by the fact that the supporting arm is divided into a mounting arm and a link holder provided on its front end adjacent the door, the link holder being mounted so that it can pivot about an axis parallel to the hinge pivot axis and can be locked at select positions relative to the mounting arm. The mounting arm is then, like the supporting arms of normal four-pivot hinges, mounted adjustably on a mounting plate fastened to the wall of the cabinet. This known hinge is essentially intended for hanging overlap doors of thick board material made of wood products, and has proven practical when properly used. However, these hinges are not suitable for polygon-front cabinets or vitrines with inset, or recessed glass doors in which angled fillers are provided between the actual cabinet opening and the side walls, which are either fixedly glazed or—preferably—are likewise closed by inset solid glass doors which permit easier access to objects located in the side areas of these cabinets. Depending on the design of the cabinet, these doors hung on the angled fillers form different angles with the wall on which they are hung. In that case, the door jamb can consist only of a wooden frame for a lateral glazing permanently set in it.

It is the object of the invention to create a hinge which is suitable for hanging an inset door, especially a glass door, on the carcase of a piece of furniture, when the angle formed between the closed door and the carcase wall differs from the conventional right angle, and which, without any change in its individual components, will be usable for a wide range of different angles between wall and door and adaptable to different angles.

SUMMARY OF THE INVENTION

Setting out from a hinge of the kind described above, this object is achieved according to the invention in that the mounting component has a bracket arm projecting from a mounting plate which can be fastened directly or indirectly on the wall and which has a mounting surface convexly curved with respect to the wall and of substantially arcuate shape in the plane of adjustment, on which a complementarily arcuate mounting surface of the link holder can be fastened at select relative positions within a specific range of adjustment. By changing the relative position of the link holder on the bracket arm, the position of the pivot axes of the link mechanism—e.g., the pivot pins on the carcase-related side of a four-joint hinge—can be adjusted to different angles of the (closed) door with respect to the wall, while the bracket arm that presumably projects from the mounting plate, together with the link holder, also permits a spacing from the wall that is sufficient for the recessed or inset arrangement of the door.

It is recommendable that the configuration be such that the radial center of the arcuate mounting surfaces be situated approximately in the area of the arris formed by the meeting of the front and edge surfaces of the closed door or slightly forward thereof. This brings it about that the mounting plate can be installed always at the same distance from the edge of the wall regardless of the angle formed between the closed door and the carcase wall, while at the same time the size of the gap between the closed door and the wall changes little or not at all at different angles. In other words, the same drilling template can be used to determine the position in which the mounting plate is to be fastened, even for different angles of the door. The radial center will be situated in front of the arris of the door especially in the case of thin doors, e.g., unframed glass doors, in which the door-related hinge part and a decorative plate covering it, if used, project beyond the front face of the door. In thicker doors of wood materials or the like, in which the door-related hinge part is a cup set flush in the back of the door, the position of the radial center of the mounting surfaces will, on the other hand, be chosen preferably such that it is adjacent to the above-mentioned arris of the door edge.

In order to secure the link holder in the proper position on the bracket arm, it is recommendable to provide mating serrations in the confronting mounting surfaces of the bracket arm and link holder in such a manner as to provide a positive hold against accidental shifting.

The link holder is then best releasably joined to the bracket arm by at least one set screw whose shaft is driven through a slot running lengthwise in one of the parts to be joined and into a tap in the other part. Preferably, the slot is provided in the link holder and the tap in the area of the free end of the bracket arm. The head of the set screw is then easily accessible from the exposed upper side of the link holder for adjustments.

The section of the link holder that is to be fastened on the mounting plate of the bracket arm can best have a slightly lesser width than the bracket arm, and then a pair of side walls can be provided on the bracket arm, reaching above its mounting surface, and between them the section of the link holder can be held, being thereby secured against lateral displacement. Especially if the link holder of a hinge that is already mounted and bearing a door should afterward have to be changed to correct a tilt, this security against lateral displacement is advantageous, because the side walls then will also be bearing the weight of the door.

A compact and solid appearance of the mounting component can result if the side walls of the bracket arm substantially conceal the section of the link holder between them.

To keep the horizontal length of the wall-related hinge part as small as possible, it is recommendable to provide the mounting plate of the mounting component with wings extending from opposite sides of the bracket arm, in each of which a slot disposed parallel to the hinge pivot axis is provided, through which the threaded shafts of screws can be driven into the cabinet wall. To the degree permitted by the length of the slots, the mounting plate, and with it the entire wall-related hinge part, can be adjusted lengthwise of the slots when the mounting screws are loosened. The slots can alternatively be disposed also at right angles to the hinge pivot axis if, instead of a height adjustment, an adjustment of the closing depth of the door is required.

It will then be desirable to provide also at least one additional mounting hole of circular cross section in the mounting plate. A screw driven through this fastening bore will then fix the mounting plate in the selected position, even though the screws in the slots have slightly loosened.

The slots and the fastening bore are best countersunk.

BRIEF DESCRIPTION OF THE DRAWING

The invention is further explained in the following description of an embodiment, in conjunction with the drawing, wherein:

FIG. 1 is a longitudinal central section through a hinge according to the invention, in the closed state, FIG. 2 is a longitudinal central section through the hinge shown in FIG. 1, with the door in the open state.

FIG. 5 is a longitudinal central section through the mounting component of the hinge, FIG. 6 is a view of the mounting component, seen in the direction of the arrow 6 in FIG. 5, FIG. 7 is a longitudinal central section through the link holder of the hinge, and FIG. 8 is a top view of the link holder seen in the direction of the arrow 8 in FIG. 7.

DETAILED DESCRIPTION OF A PREFERRED EMBODIMENT

Figure 3:
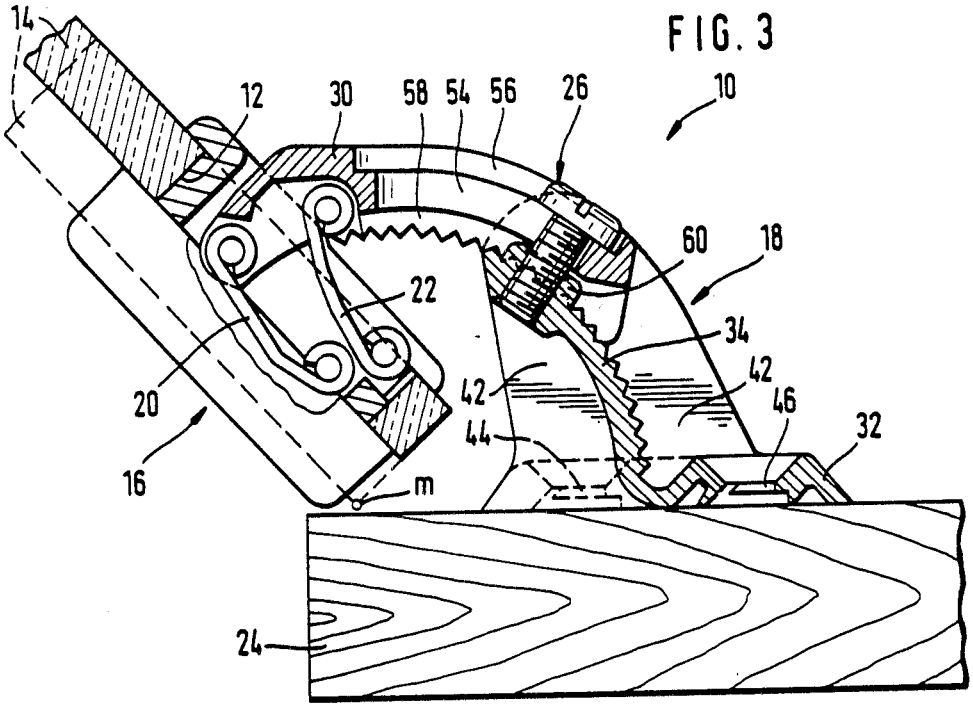
FIG. 3 is a longitudinal central section through the hinge of FIGS. 1 and 2, shown in the closed state, with the link holder in an altered position on the arm.
Figure 4:
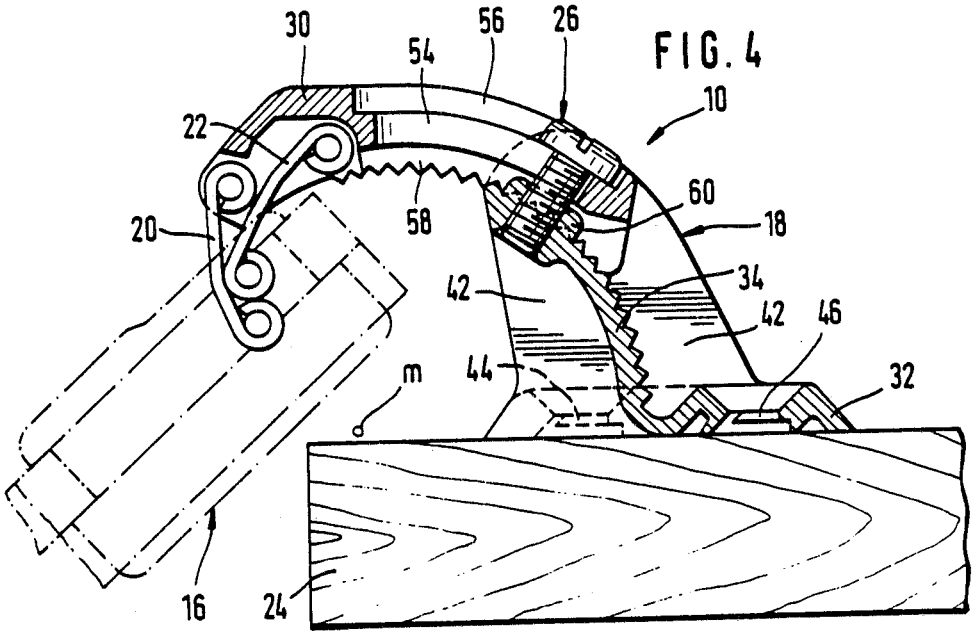
FIG. 4 is a longitudinal central section through the hinge according to FIG. 3, in the open state.

The hinge according to the invention, identified by the number 10 in FIGS. 1, 2, 3 and 4, is, in the case represented, a so-called four-pivot hinge, in which a cup-like door-related part 16 is set in a through-bore 12 in a solid glass door 14 and covered by a decorative plate on the outer side of the door 14 and is pivotingly joined to a wall-related hinge part 18 by two hinge links 20 and 22. The wall-related hinge part 18 is fastened to the wall 24 of the cabinet carcase. It can be seen in FIGS. 1 and 3 that the hinge 10 is so constructed that the solid glass door 14, which is an inset door, forms an angle different from the conventional right angle with the wall when it is in the closed state. In the case of the hinge shown in FIGS. 1 and 2, this angle between the door and the wall in the closed state amounts to approximately 100°, while in the case of the hinge shown in FIGS. 3 and 4 it amounts to about 135°. Also, the hinge 10 according to FIGS. 1 and 2 is identical to the hinge 10 in FIGS. 3 and 4, but it is adjusted to a different closed-door angle. This adjustment is performed exclusively within the wall-related hinge part 18 whose components, except for a set screw 26, are shown again in detail in FIGS. 6 to 8.

The wall-related hinge part 18 is composed of the mounting component 28 (FIGS. 5 and 6) which can be fastened directly on the wall 24, and the link holder 30 (FIGS. 7 and 8) which is fastened so as to be adjustable, by means of the above-mentioned set screw, on this mounting component 28.

The mounting component 28 consists, in turn, of a mounting plate 32 of triangular shape in plan, in the embodiment represented, from whose surface projects a curved bracket arm 34, which in turn has, as seen in a side view, a substantially arcuate mounting surface 36 which is provided with parallel teeth 38 of triangular cross section disposed transversely, i.e., at right angles to the direction of adjustment, the teeth forming together on the mounting surface 36 a similarly arcuate rack. Adjacent its free end, the bracket arm 34 is provided with a tap 40 into which the shaft of the above-mentioned set screw 26 can be driven. Along the two opposite lateral margins of the bracket arm 34, the latter has side walls 42 which project above the mounting surface 36, and which on the other hand are also brought under the mounting surface to the mounting plate 32 and thus strengthen the bracket arm 34 on the mounting plate against deformation due to bending stresses. The sections of the side walls 42 which project above the mounting surface 36 on the sides facing away from the mounting plate furthermore serve the purpose of forming lateral guides for the link holder to be described further on. The beveled slots 44 which are formed in the lateral projections on opposite sides of the bracket arm serve for the fastening of the wall-related hinge part 18 on the wall 24 by means of screws, preferably flat-head screws in this case (not shown), which can be driven through them into the wall 24. When these screws are loosened, an adjustment, limited by the length of the slots 44 of the mounting plate and hence of the entire hinge, can be performed parallel to the hinge pivot axis, i.e., a height adjustment of a door mounted by the hinge 10 for pivoting about a vertical axis on a cabinet carcase, is possible. The countersunk bore 46 of circular cross section additionally provided in the mounting plate 32 directly in back of the bracket arm 34 then permits the fixing of an adjusted height by means of a screw additionally driven through that hole into the wall, if its shaft diameter directly beneath its flat head is approximately equal to the free diameter of the bore 46.

The link holder 30 (FIGS. 7 and 8) is simply a curved bracket arm which terminates at its free front end, on the left in the drawings, in two laterally spaced lugs 48 in which bores are provided for the pins (not shown) on which the hinge links 20 and 22 of the four-joint mechanism are pivoted. The greater remaining length of the link holder 30 contains a central slot 54 whose width is approximately equal to or only slightly larger than the diameter of the shaft of the set screw 26. On the upper side facing away from the bracket arm 34, as well as on the bottom side, the slot 54 is provided with ledges 56 and 58, respectively, to accommodate the head of the setscrew 26 in the one case and for a collar-like projection 60 (FIGS. 5 and 6) on the bracket arm 34, which surrounds the tap 40 and increases its threaded length.

The strips 62 remaining on the link holder 30 alongside the ledge 58 form the link holder's mounting surface, i.e., they are curved to complement the mounting surface 36 of the bracket arm 34, and are also provided each with parallel teeth 64 forming a rack which meshes with the rack formed by the teeth 38 of the bracket arm 34. The link holder 30 can thus be set at selectable steps along the bracket arm 34 according to the pitch of the teeth of the racks. Then it can be locked in the selected position on the bracket arm by means of the set screw 36. The maximum range of adjustment can be understood from a comparison of FIGS. 1 and 2 with FIGS. 3 and 4, in which the extreme end position of the link holder 30 relative to the bracket arm 34 is shown. At the same time it can be understood also how the angle of inclination of the solid glass door 14 changes in the closed position (FIGS. 1 and 3) relative to the wall 24 in relation to the position of the link holder 30 relative to the bracket arm 34.

Indentations 66 are made on the upper side of the link holder 30 at regular intervals proportional to the pitch of the teeth 38 and 64, and they are associated each with an indentation 68 made on the side walls 42. Depending on which of the indentations 66 is opposite the indentation 68 it is easily possible to determine at a glance the angle of inclination of the closed door 14 relative to the carcase wall 24, for which the link holder 30 has been set on the bracket arm 34.

In addition to the hanging of doors so as to open within a range of different angles to the wall, the hinge 10 that has been described is also to be configured such that the mounting plate 32 can be fastened always at the same distance from the front edge of the wall, regardless of the given angle enclosed between the door and the wall. Also, the size of the gap between the (closed) door 14 and the inside surface of the carcase wall 24, must not change appreciably in the event of changes in the angular setting of the link holder 30 on the bracket arm 34. Therefore, the curvature of the bracket arm 34 and of the link holder must be selected according to these conditions such that the center point m of the curvature coincides approximately with the front edge of the closed door. These conditions can be satisfied precisely only for a specific thickness of the door. If the hinge is used for thicker or thinner doors, the center point m of the curvature will then be shifted slightly inward with respect to the above-mentioned front edge of the closed door in the one case and slightly ahead of the front surface of the door in the other.

I claim:

1. A hinge for hanging a door, especially a glass door, on a wall of a piece of furniture; said hinge comprising: a door-related part for mounting at the door; a wall-related part, including: mounting means having a mounting surface for mounting to the wall, said mounting surface defining a plane; a link holder; and link means pivotally connecting said link holder to said door-related part, so as to be pivotable about a pivot axis; said wall-related part including a bracket arm projecting from said mounting means and defining a first substantially arcuate surface convexly curved relative to the mounting surface; said link holder defining a second substantially arcuate surface complementary to the first arcuate surface; and means for adjustably connecting said bracket arm and link holder at said first and second arcuate surfaces in selected relative positions to each other, in a plane perpendicular to said pivot axis.

2. A hinge according to claim 1, comprising means for fastening said mounting means to a wall having a front edge, such that the arcuate surfaces have radial centers located approximately at the front edge.

3. A hinge according to claim 1, wherein said first and second arcuate surfaces have serrations of equal division running parallel to the pivot axis.

4. A hinge according to claim 1, wherein said connecting means includes tap means in one of said bracket arm and link holder, an elongated slot in the other one of said bracket arm and link holder, and set screw means having threaded shaft means passing through said slot and threadedly engaging said tap means.

5. A hinge according to claim 4, wherein said slot is in said link holder and said tap means is in said bracket arm.

6. A hinge according to claim 1, wherein said link holder is of slightly lesser width than said bracket arm in a direction parallel to the pivot axis, and wherein said bracket arm has side walls projecting beyond said first arcuate surface, said link holder being guided by said side walls as security against lateral shifting on the bracket arm.

7. A hinge according to claim 6, wherein said link holder is laterally substantially completely covered by said side walls.

8. A hinge according to claim 1, wherein said mounting means has wing-like flange projections extending on opposite sides of said bracket arm, one slot in each of said projections and running parallel to the pivot axis, for fastening screws to be driven into the wall.

9. A hinge according to claim 8, comprising at least one bore of circular cross section in said mounting means.

10. A hinge according to claim 9, wherein said slots and bore are countersunk.

* * * * *